United States Patent [19]

Waring

[11] Patent Number: 4,626,133

[45] Date of Patent: Dec. 2, 1986

[54] WATERSTOP FOR MONOLITH JOINTS

[75] Inventor: Stephen T. Waring, Salem, Oreg.

[73] Assignee: Gelco Grouting Service, Salem, Oreg.

[21] Appl. No.: 650,233

[22] Filed: Sep. 13, 1984

[51] Int. Cl.[4] ..... E02B 7/10; E02B 3/10

[52] U.S. Cl. ..... 405/107; 405/135; 405/152

[58] Field of Search ..... 405/107, 135, 152, 108–117; 156/71, 148; 254/134.4, 134.3 FT; 138/97

[56] References Cited

U.S. PATENT DOCUMENTS

| | | | |
|---|---|---|---|
| 2,277,286 | 3/1942 | Bechtner | 405/107 |
| 2,333,826 | 11/1943 | Smith et al. | 405/152 X |
| 2,794,758 | 6/1957 | Harper et al. | 405/154 X |
| 4,009,063 | 2/1977 | Wood | 156/71 |
| 4,064,211 | 12/1977 | Wood | 264/95 |
| 4,202,531 | 5/1980 | Hamrick | 254/134.4 |
| 4,456,401 | 6/1984 | Williams | 405/146 X |

FOREIGN PATENT DOCUMENTS

| | | | |
|---|---|---|---|
| 1079091 | 4/1960 | Fed. Rep. of Germany | 405/152 |

OTHER PUBLICATIONS

Journal of the Energy Division, 1980 Paper on Remedial Waterstops Repair of Waterstop Failures, Ernest K. Schrader, M.ASCE.

*Primary Examiner*—Dennis L. Taylor
*Attorney, Agent, or Firm*—Eugene M. Eckelman

[57] ABSTRACT

A tubular member is arranged to be inserted in a hole drilled in adjacent monoliths astraddle a joint between the monoliths. A tubular member comprises an outer layer of material saturated with a resin capable of bonding to defining walls of the hole. An inner layer of fluid impermeable material is bonded to the outer layer of tubular member. Prior to installation, the tubular member is non-inverted, having the resin saturated layer on the inside whereby upon being inverted into the hole by an inverting gas or fluid, the resin saturated layer turns outwardly for bonding to the walls of the hole. A core portion is placed in the tube to hold it in tight bonded engagement with the hole, such core portion comprising a grout having an elasticity which when cured flexes with differential movements of adjacent monoliths.

12 Claims, 7 Drawing Figures

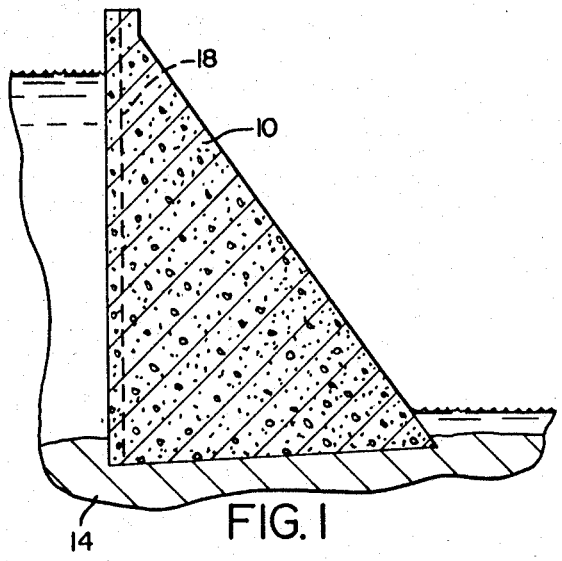
FIG. 1
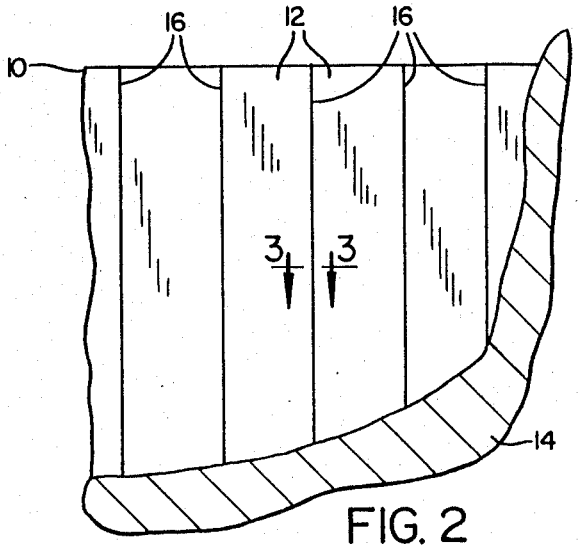
FIG. 2
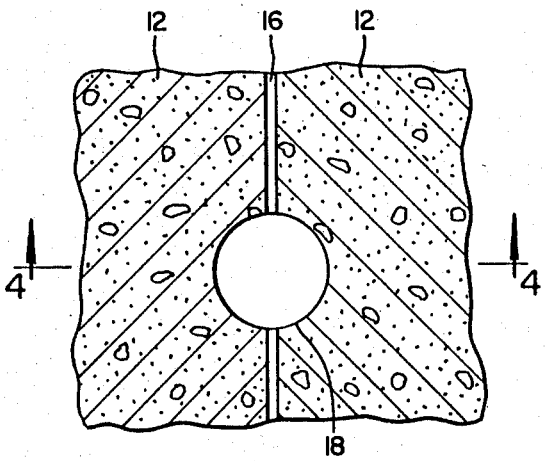
FIG. 3
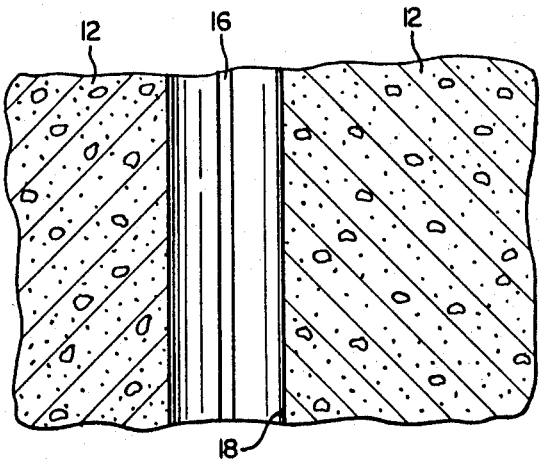
FIG. 4
FIG. 5
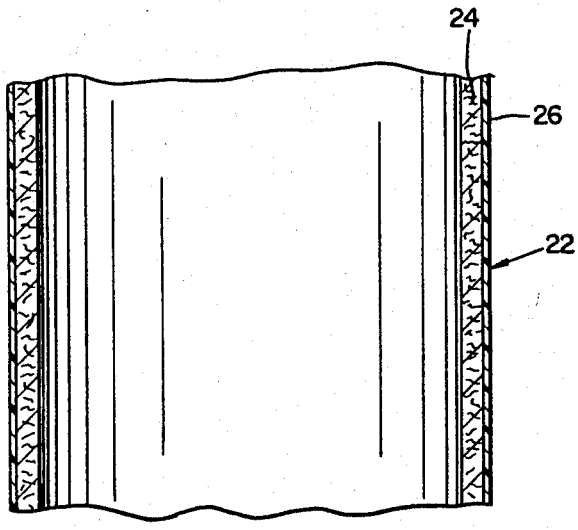

WATERSTOP FOR MONOLITH JOINTS

BACKGROUND OF THE INVENTION

Monolith joint waterstops are necessary in dams, power houses, navigation locks, and other structures, and these waterstops have been of several structures. In many instances, adjacent monoliths have different foundation support which may cause relative movement between these monoliths. Also, seasonal climatic changes can open and close the joints due to thermal expansion and contraction. Varying hydraulic loading conditions also effect movement. The joints must remain free to accommodate these movements. A common type of waterstop comprises embedded copper plates with a fold along the joint. More recently, embedded poly-vinyl-chloride waterstops have been used which are inserted in vertical holes cut in straddling relation to the joint between the monolith. Other types of waterstops have also been provided but in general all of the prior structures do not possess a combination of desired features, namely, a structure which makes them readily installable, including installation under water pressure conditions, which provides an effective seal, which accommodates relative movement between adjacent monoliths, which is long lasting and which is capable of being readily repaired or replaced. Remedial waterstops heretofore installed have not performed satisfactorily, not only for the same reasons surrounding the circumstances of installation construction as well as material failure.

SUMMARY OF THE INVENTION

According to the present invention and forming a primary objective thereof, a waterstop for monolith joints is provided which is readily installable, including installation under water pressure conditions, which provides an effective seal, which accommodates relative movement between adjacent monoliths, which is long lasting in service, and which can be repaired or replaced if necessary.

Another object is to provide a method of constructing the waterstop of the invention.

In carrying out these objectives, a vertical hole is made down the joint between adjacent monoliths and has a radial dimension such that the hole extends on each side of or straddles the joint. The present waterstop is formed by a long, continuous, strong but flexible tube of heavy carrier material which is impregnated with adhesive, flexible, water-reactive resin and which is inserted in the hole and held tight against the wall of the hole by a flexible filler grout. The tube is bonded to a layer of fluid impermeable plastic. In the installation of the tube in the cut hole, the tube with the felt carrier as the inside layer is saturated with the resin and then forced into the cut hole while being turned inside out by fluid pressure supplied from inverting apparatus. This places the fluid impermeable layer on the inside of the tube and the resin saturated felt on the outside for bonding to defining walls of the hole. Sealing pressure for the resin is provided by the inverting fluid in the tube. With the tube fully installed in the hole, a filler of elastic chemical grout which is more dense than the inverting fluid is tremied into the hole to displace the inverting fluid and to form a permanent core which holds the impregnated felt tight against the wall of the hole.

The invention will be better understood and additional objects and advantages will become apparent from the following description taken in connection with the accompanying drawings.

BRIEF DESCRIPTION OF THE DRAWINGS

FIG. 1 is a diagrammatic side elevational view of a dam for illustrating an exemplary monolith structure with which the instant invention may be used;

FIG. 2 is a diagrammatic view of a face portion of the dam taken from the left of FIG. 1;

FIG. 3 is an enlarged fragmentary sectional view taken on the line 3—3 of FIG. 2 and showing an initial step of the invention wherein a hole is made between adjacent monoliths;

FIG. 4 is a sectional view taken on the line 4—4 of FIG. 3;

FIG. 5 is an enlarged fragmentary sectional view showing the structure of a tube member which in a subsequent step is installed in the hole between monoliths;

DETAILED DESCRIPTION OF PREFERRED EMBODIMENT

Reference is first made to FIGS. 1 and 2 which show conventional monolith structure. The structure illustrated comprises a dam 10 formed of adjacent monoliths 12. The monoliths are seated on bedrock 14 and separated by vertical joints 16, also seen in FIGS. 3 and 4. These joints are provided with suitable waterstops, not shown, which have failed and leakage occurs through the joints to be repaired.

Figure 7:
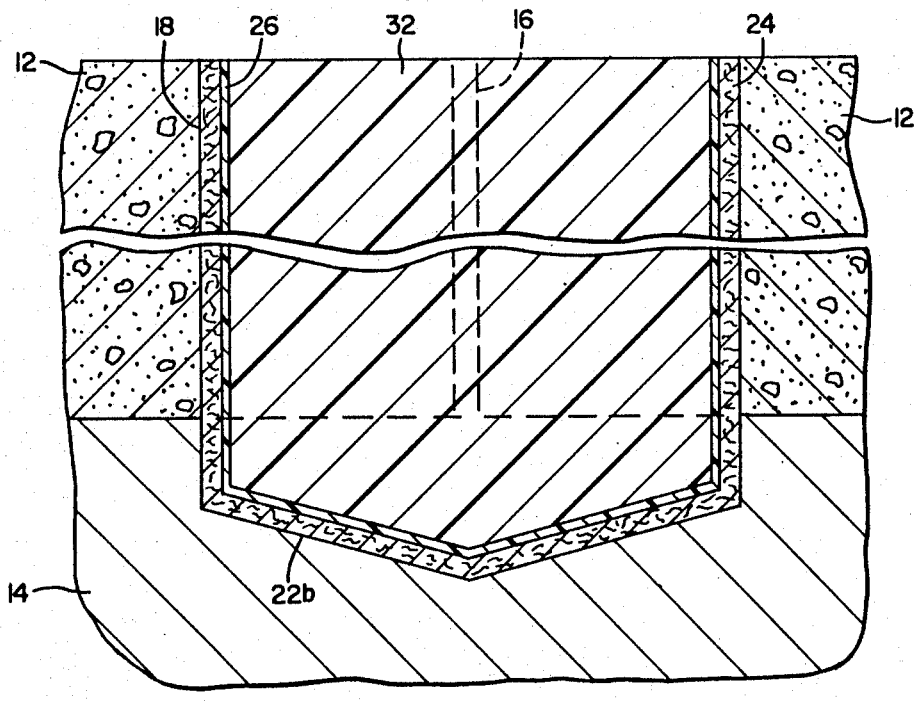
FIG. 7 is an enlarged sectional view also taken similar to FIG. 4 showing the installed tube and a filler therein.

FIG. 3 shows a first step of constructing the present waterstop. Such comprises drilling a hole 18 in straddling relation to the joint 16. This hole is drilled to the desired diameter and to the desired depth such as to a point below the leak or fully down into bedrock 14 if desired, as seen in FIG. 7.

In connection with the invention, a long, continuous, strong but flexible tube 22 is utilized for placement in the hole 18 in a manner later to be described. With particular reference to FIG. 5, this tube comprises a carrier layer 24 for a water reactive resin. This layer is integrated with an outer thin layer 26 of fluid impermeable material such as plastic. The resin carrier layer 24 may be made up of a single layer of material or multiple layers. It may be formed from flat material into tubular form by suitable joining of edge portions, as by stitching, followed by a sealing closure strip over the stitches.

In the process of installing the present water stop, the layer 24 is first saturated with flexible resin. This process is carried out with the tube 22 in its FIG. 5 non-inverted form, namely, the layer 24 being on the interior of the tube. For the purpose of saturating the layer 24, resin is pumped into the tube and the tube drawn through pinch rollers which force the resin throughout the length of the tube to thoroughly saturate the layer 24. The fluid impermeable layer 26 comprises the container for the resin during this process.

Figure 6:
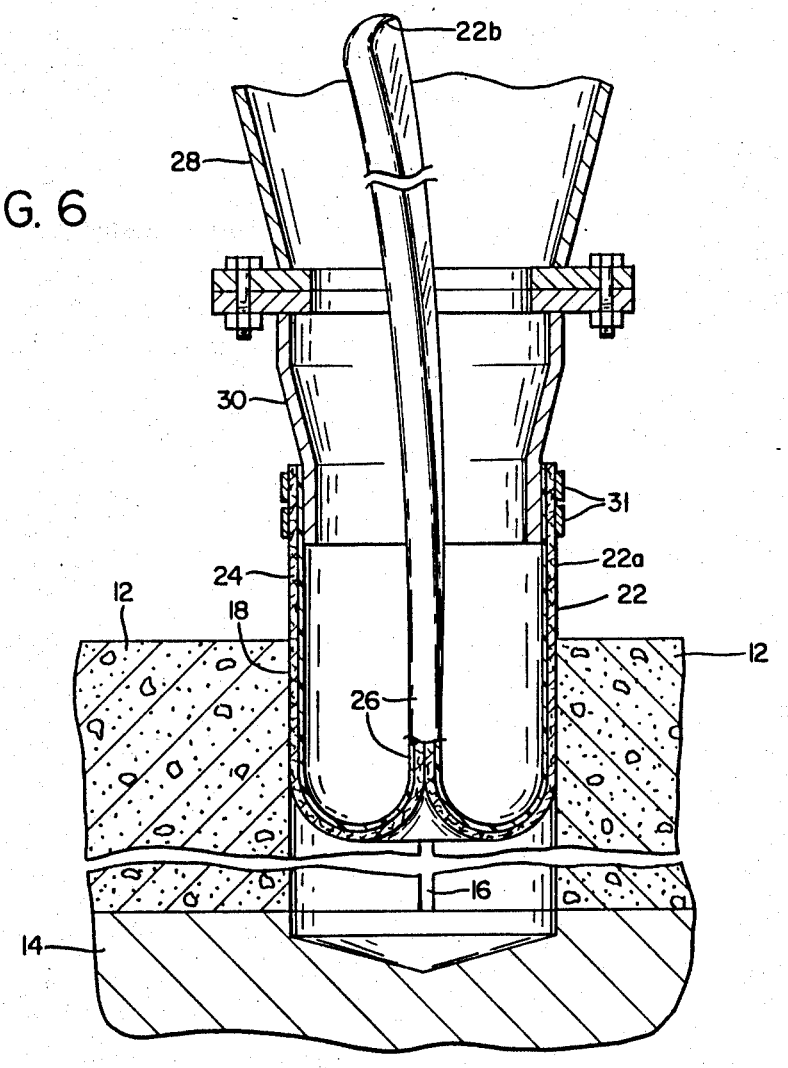
FIG. 6 is a sectional view taken similar to FIG. 4 and showing apparatus and process for inverting the tube of FIG. 5 in the cut hole made between monoliths.

With the hole 18 properly cleaned and the tube saturated with resin, and with reference to FIG. 6, the tube is then installed in the hole by inverting apparatus 28 having a hollow nozzle portion 30 through which the tube 22 extends. One end 22*a* of the tube is doubled back and secured, as by bands 31, to the nozzle 30 of the inverting apparatus. The end portion 22*a* will comprise the top of the tube in its installed position. With reference to FIG. 7, the other end 22*b* of the tube is closed and such will comprise the bottom end when installed. Prior to installation, the tube is preselected in length so that the closed end 22*b* will bottom out at the proper distance in the hole. During installation, the bottom end will disappear down the hole at about the half-way point of installation. As stated, the hole 18 extends the desired depth in the monolith portions and may extend into bedrock if desired, FIG. 7.

The inverting apparatus 28 utilizes pressured fluid through the nozzle 30 whereby with the end 22*a* of the tube 22 attached to the apparatus, pressured fluid is utilized to turn the tube inside out. This pressured fluid may comprise liquid or gas. As the tube turns inside out and progresses down the hole, it is maintained full of fluid, and with suitable pressure therein, including head pressure if a liquid such as water is used as the inverting fluid, the resin in the layer 24 will be pressed against and bonded securely to the walls of the hole. If a gaseous form is used as the inverting medium, it is admitted under suitable inverting pressure which also is used to press the layer against the walls of the hole.

In the inverted, installed position of the tube 22, FIG. 7, the layer 26 is directed inwardly. The tube is then filled with an elastic chemical grout gel 32 having a density greater than water. This filler can be installed immediately after the tube is inserted or after some cure time of the resin. Since the density of the grout 32 is greater than water, it will displace water when poured in without added pressure. If a gaseous form is used to invert the tube, its pressure merely is released as the grout filling is placed. The filler 32 forms a core portion and maintains the resin of layer 22 in constant pressure bonded relation with the monolith. Since it is an elastic grout, it can flex and move with any relative movement of the monoliths.

The layer 24 may comprise any suitable carrier of resin absorbent material. An excellent material for this purpose comprises polyester needle felt. Representative thicknesses comprise between 3 and 7 mm. and the fineness of the felt for effective saturation is around 6 denier.

The resin used for saturating the layer 24 comprises a water reactive resin designed for sealing cracks and joints. When cured, it is desired that the resin form a dense solid structure with good tensile strength and good bonding to concrete. Also, the cured resin must be flexible to resist degradation through thermal expansion and contraction as well as wet and dry cycles and freeze and thaw cycles for long periods of time. It is also desirable that the resin have good resistance to attack by fungi, acids, alkalies and gases normally found in soil and commercial structures. Such resins are available on the market as concrete crack and joint sealants, a representative resin comprising that available from Avanti International under the trade name AV-220 Hydracure Injection Resin.

The layer 26 may comprise an available polyurethane film which has the known characteristics of being fluid impermeable and capable of being bonded to the felt layer. Its thickness approximates 20 mils and can be bonded to the layer 24 in any suitable manner such as by spraying.

The filler 32 comprises a suitable elastic chemical grout gel such as acrylamide grout mixture. If necessary, the specific gravity thereof may be increased by Celite or by the use of glycerine and/or ethylene glycol. It is necessary that this grout have characteristics of elasticity sufficient to distribute shear stress caused by the strain of differential movement between monoliths. This resin must also serve as a secondary waterstop in itself should either the felt, the resin, or both fail.

According to the invention, a waterstop is provided that is readily installable, including installation under water pressure conditions which may exist from leakage. The waterstop provides an effective seal and readily accommodates differential movement between monoliths. It has a long life and can be readily replaced if necessary. Although it is intended primarily for remedial purposes, it can also be used as an original waterstop.

It is to be understood that the form of my invention herein shown and described is to be taken as a preferred example of the same and that various changes in the shape, size and arrangement of parts and type of materials may be resorted to without departing from the spirit of my invention, or the scope of the subjoined claims. For example, although the above structure illustrates the use of a round hole, such hole can be of other shapes. Also, the hole could pre-exist and it may not be necessary to drill one.

Having thus described my invention, I claim:

1. A waterstop for sealing a vertical joint between monoliths comprising a tubular member arranged to be inserted in a hole provided in adjacent monoliths astraddle a joint therebetween, said tubular member comprising an outer layer of material saturated with a resin capable of bonding to defining walls in the hole, an inner layer of fluid impermeable material bonded to said outer layer, and a permanent core portion filling the interior of said tube to maintain the tubular member in tight bonded engagement with the defining walls of the hole against head pressure of water behind said monoliths.

2. The waterstop of claim 1 wherein said resin comprises a water reactive resin.

3. The waterstop of claim 1 wherein said resin comprises a water reactive polyurethane.

4. The waterstop of claim 1 wherein said outer layer comprises a resin absorbent felt.

5. The waterstop of claim 1 wherein said core portion comprises a grout of a type having an elasticity when cured to flex with differential movements of adjacent monoliths.

6. The waterstop of claim 1 wherein said core portion comprises a grout of a type having an elasticity when cured to flex with differential movements of adjacent monoliths, said grout in a liquid state thereof having a density greater than water.

7. The waterstop of claim 1 wherein said tube is invertible whereby said outer layer in a non-inverted condition of said tube is on the inside and thus capable of being saturated with said resin supplied to the interior thereof and capable of lining a hole as the tube is inverted.

8. The method of forming a waterstop in a vertical hole cut in adjacent monoliths astraddle a joint therebetween comprising the steps of lining the hole with a tubular member having a first layer saturated with a water reactive resin for bonding to defining walls of the hole and a second layer of fluid impermeable material bonded to said first layer, and inserting a permanent core portion of grout interiorly of said tubular member of a type having an elasticity when cured to flex with differential movements of adjacent monoliths and a density to hold said tubular member in tight bonded engagement with defining walls of the hole and to withstand head pressure of water behind said monoliths.

9. The method of claim 8 wherein said tube is invertible and said first layer in a non-inverted condition of said tube is on the inside, said method including the step of saturating said first layer with said resin prior to lining a hole with said tubular member, said method also including the step of inverting said tubular member as it is inverted in the hole to dispose said first layer outwardly for abutment against defining walls of the hole and to dispose said second layer inwardly to receive said core portion.

10. The method of claim 9 wherein said tubular member is inverted by fluid pressure.

11. The method of claim 9 wherein said tubular member is inverted by fluid pressure directed thereinto, said pressure being greater than exterior head pressure to force said tubular member against the defining walls of the hole.

12. The method of claim 9 wherein said tubular member is inverted by fluid pressure directed thereinto, said pressure being greater than exterior head pressure to force said tubular member against the defining walls of the hole, said core member being formed by pouring said grout into said inverted tubular member to displace said water.

* * * * *